US005727962A

United States Patent [19]

Caveney et al.

[11] Patent Number: 5,727,962

[45] Date of Patent: Mar. 17, 1998

[54] MODULAR PLUG CONNECTOR

[76] Inventors: Jack E. Caveney, 546 Dalewood La., Hinsdale, Ill. 60521; Royal O. Jenner, 7531 W. 175th St., Tinley Park, Ill. 60477; Russell A. Vanderhoof, 17261 S. Drauden Rd., Plainville, Ill. 60544

[21] Appl. No.: 536,810

[22] Filed: Sep. 29, 1995

[51] Int. Cl.[6] ..... H01R 4/50

[52] U.S. Cl. ..... 439/344; 439/404; 439/354

[58] Field of Search ..... 439/344, 345, 439/350, 353, 354, 357, 358, 676, 404

[56] References Cited

U.S. PATENT DOCUMENTS

| | | | |
|---|---|---|---|
| 3,860,316 | 1/1975 | Hardesty . | |
| 4,002,392 | 1/1977 | Hardesty . | |
| 4,054,350 | 10/1977 | Hardesty . | |
| 4,143,935 | 3/1979 | Goodman et al. . | |
| 4,160,575 | 7/1979 | Schraut . | |
| 4,272,145 | 6/1981 | LaDuke . | |
| 4,758,536 | 7/1988 | Miller et al. . | |
| 4,986,766 | 1/1991 | Leonard et al. . | |
| 5,100,339 | 3/1992 | Sato et al. . | |
| 5,194,014 | 3/1993 | McClune et al. . | |
| 5,284,447 | 2/1994 | Kristiansen . | |
| 5,295,855 | 3/1994 | Walz . | |
| 5,389,006 | 2/1995 | Noschese | 439/354 |
| 5,429,522 | 7/1995 | Noschese et al. | 439/344 X |
| 5,462,457 | 10/1995 | Schroepfer et al. | 439/344 X |

OTHER PUBLICATIONS

Stewart Connector Systems, Inc. Category 5 Performance 1995 Product Bulletin consisting of two pages.

*Primary Examiner*—Khiem Nguyen

*Attorney, Agent, or Firm*—Mark D. Hilliard; Robert A. McCann; Michael J. Turgeon

[57] ABSTRACT

A modular plug connector that achieves category five cross talk performance is constructed with an array of substantially planar conductor positioning channels that position individual conductors for termination by a plurality of flat insulation displacement contacts. A plurality of conductor termination slots are formed parallel to and communicating with every other one of the conductor positioning channels such that insertion of insulation displacement contacts during termination of the contacts to the conductors forces every other conductor into a respective slot offsetting or staggering adjacent conductors. The modular plug is provided with a latch arm that includes a free end that extends downwardly toward a top wall of the connector to terminate in close proximity to the surface of the connector or extends into a depression in the surface of the connector to prevent snagging or tangling of the latch arm with other connectors or surfaces.

15 Claims, 7 Drawing Sheets

MODULAR PLUG CONNECTOR

TECHNICAL FIELD

The present invention relates generally to modular communication connectors for electrically terminating and connecting conductors of communication cables, and relates specifically to modular plug connectors that mate with the socket of modular jack connectors.

BACKGROUND ART

Many different modular plugs of generally similar outward configuration, necessitated by the requirement of mating with a standard modular jack, are in wide use or have been proposed. For example note U.S. Pat. No. 4,054,350 to Hardesty.

Modular plugs are relatively small in size, with the close proximity of the contacts and terminated ends of the conductors inducing cross talk between different signal pairs in prior art plug connectors.

The use of modular communication plugs and jacks to connect twisted pair cables in computer networks with ever increasing data transmission rate requirements results in a continuing need to reduce the cross talk between signal transmitting wire pairs induced by the modular communication connectors.

The relatively small size of the plugs and conductors also requires careful manipulation of individual insulated conductors to accurately arrange the order of the conductors relative to the contacts in the modular plug and to insert and hold the conductors in the plug in the proper arrangement until the plug can be terminated to the conductors. Typically, eight individual insulated conductors must be arranged and terminated to eight contacts in the plug.

A plug manufactured by Stewart Connector Systems, Inc. utilizes a separate wire load bar that allows retention of the twist in each wire pair up to the edge of the load bar to reduce the amount of cross talk induced in adjacent wires when compared to prior plug connectors. The load bar complicates the manufacture of the plug and increases the difficulty of assembly of the plug relative to prior art plugs where the distal end of the twisted wires can merely be straightened and inserted in a planar array into the plug without the careful manipulation of each wire into the load bar.

Thus, there is need for improvement in the art for a modular plug connector that can be easily terminated while reducing the cross talk induced by the connector in terminated wire pairs.

Modular plugs typically are provided in multi-part bags and are terminated to cables to form cable harnesses that are used in confined spaces, such as patch panels or within trunking, such that it is desirable that the plugs not become entangled or snagged with other plugs, with other cable harnesses or some other surface. Prior art plugs include a latching arm that projects away from the body of each plug.

See U.S. Pat. No. 5,100,339 to Sato et al. which proposes the use of a thin key member formed on the plug to mate with a slit in the end of the latch arm. This proposed solution appears to be difficult to manufacture with the thin key member being easily damaged. Also note FIG. 11 of Sato '339, which discloses a prior art connector that utilizes upwardly projecting blocking walls positioned on either side of and closely adjacent to the latch arm to prevent the latch arm from tangling with other surfaces. These blocking walls interfere with the release of the latch to remove the plug from a jack.

Thus there is a need in the art for an improved plug connector that prevents the latching arm of the plug from tangling with other objects without interfering with the manipulation of the latch to release the plug from a jack.

SUMMARY OF THE INVENTION

It is the object of the present invention to provide a connector that reduces cross talk between the conductors pairs terminated in the connector and that is simply terminated by inserting a planar array of conductors into the connector.

It is an additional object of the present invention to provide a method of terminating a connector to a plurality of conductors in such a manner that reduces cross talk between conductor pairs terminated in the connector.

It is another object of the present invention to provide a connector that prevents the entanglement of the latching arm of the connector with other connectors or surfaces.

In general, a connector for terminating a plurality of conductors of a plurality of conductor pairs includes first means for initially positioning the conductors in a substantially planar array and second means for positioning at least one of the conductors away from another one of the conductors such that cross talk between the conductor pairs is reduced. The first means for positioning the conductors includes a plurality of substantially planar conductor positioning channels and the second means for positioning includes at least one conductor termination slot disposed adjacent one of the conductors and a translation contact mounted in the connector and aligned with a conductor positioning channel and an adjacent conductor termination slot such that a termination force applied to the contact moves the contact against a conductor initially positioned in the aligned conductor positioning channel and moves the conductor into the aligned conductor termination slot.

A method of terminating a connector to a plurality of conductors, where the connector includes a plurality substantially planar conductor positioning channels with at least one channel disposed adjacent to at least one conductor termination slot, includes the steps of arranging the conductors in a substantially planar array; inserting the array of conductors into the conductor positioning channels of the connector; and moving at least one of the conductors into a conductor termination slot away from an adjacent conductor in the array such that cross talk between the conductors is reduced.

A tangle free connector having a latch arm projecting outwardly from the connector, includes an inwardly protecting free end portion formed on the latch arm, the free end portion projecting inwardly toward a surface of the connector to a point in sufficient proximity with the surface such that the latch arm is less likely to tangle or snag with other objects. A depression can be formed in the connector surface disposed to receive a tip of the free end such that the tip extends below the surface of the connector.

DESCRIPTION OF THE PREFERRED EMBODIMENTS

Figure 1:
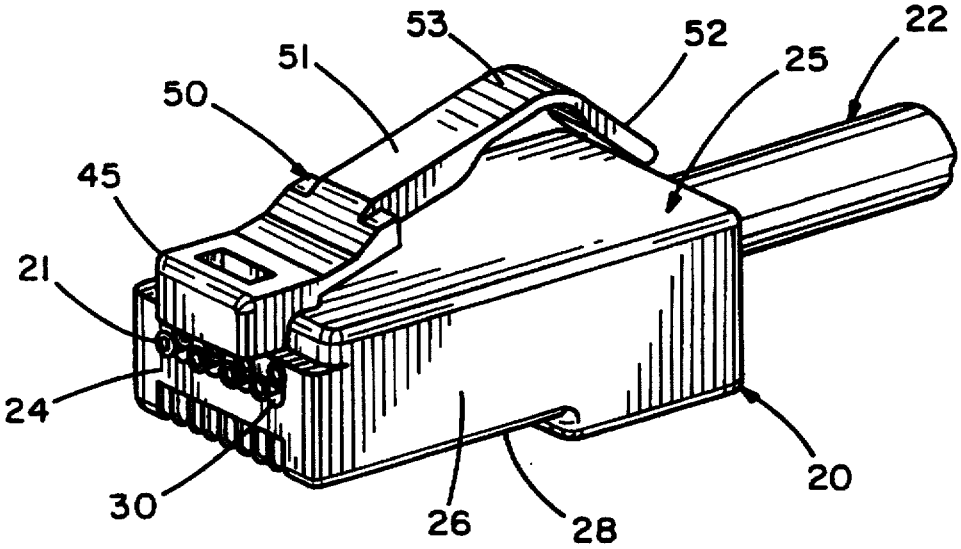
FIG. 1 is a perspective view of a modular plug connector, seen from the front, embodying the concept of the present invention.
Figure 2:
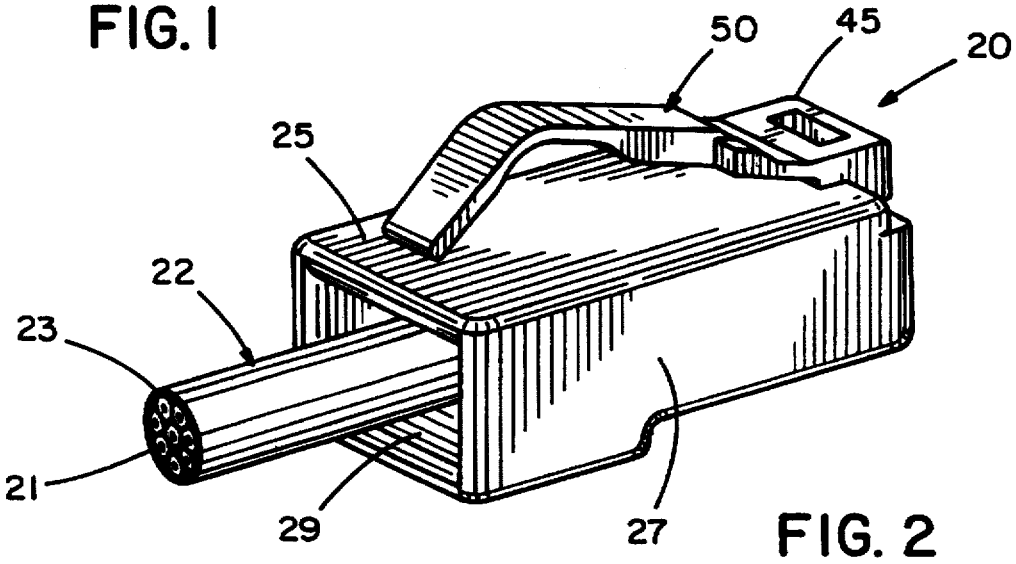
FIG. 2 is a perspective view, seen from the rear, of the connector of FIG. 1.

A modular communication plug connector embodying the concept of the present invention is designated generally by the numeral 20 in the accompanying drawings. Modular plug 20 is integrally formed of polycarbonate.

Preferably modular plug connector 20 is designed to terminate insulated conductors 21 of a twisted pair cable 22. Signal pairs of conductors 21 are twisted together along their length to reduce cross talk between conductors 21 and are enclosed in a protective sheath 23 of cable 22. Connector 20 also can be used to terminate untwisted pair cable, flat cable or any cable, the conductors of which are formed or can be formed into a planar array.

Figure 5:
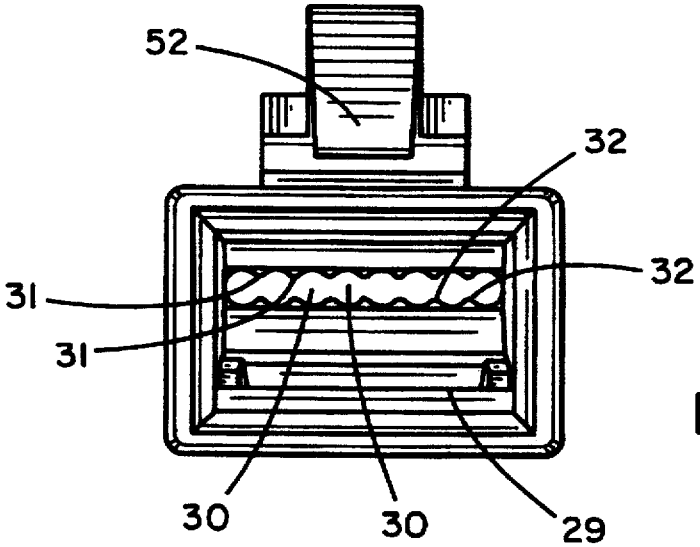
FIG. 5 is a rear view of the connector of FIG. 1.

Plug 20 includes a front face 24, a top wall 25, first and second side walls 26 and 27, and a bottom wall 28 which together define a cable receiving channel 29. Channel 29 communicates with a substantially planar array of eight conductor positioning channels 30 formed in top wall 25 and extending through front face 24, each conductor positioning channel 30 is defined on upper and lower surfaces by upper and lower ridges 31 and 32 (FIG. 5) which are spaced apart an amount to receive and accurately position individual conductors 21 there between. Channels 30, preferably allow insertion of the distal end of conductors 21 through connector 20 and past front face 24 to allow conductors 21 to be grasped and pulled outwardly to draw the twisted portion of each conductor pair as far as possible into connector 20 in order to minimize the extent of the parallel distal portion of adjacent conductors 21 and thus reduce cross talk between wire pairs to enhance connector performance.

Figure 6:
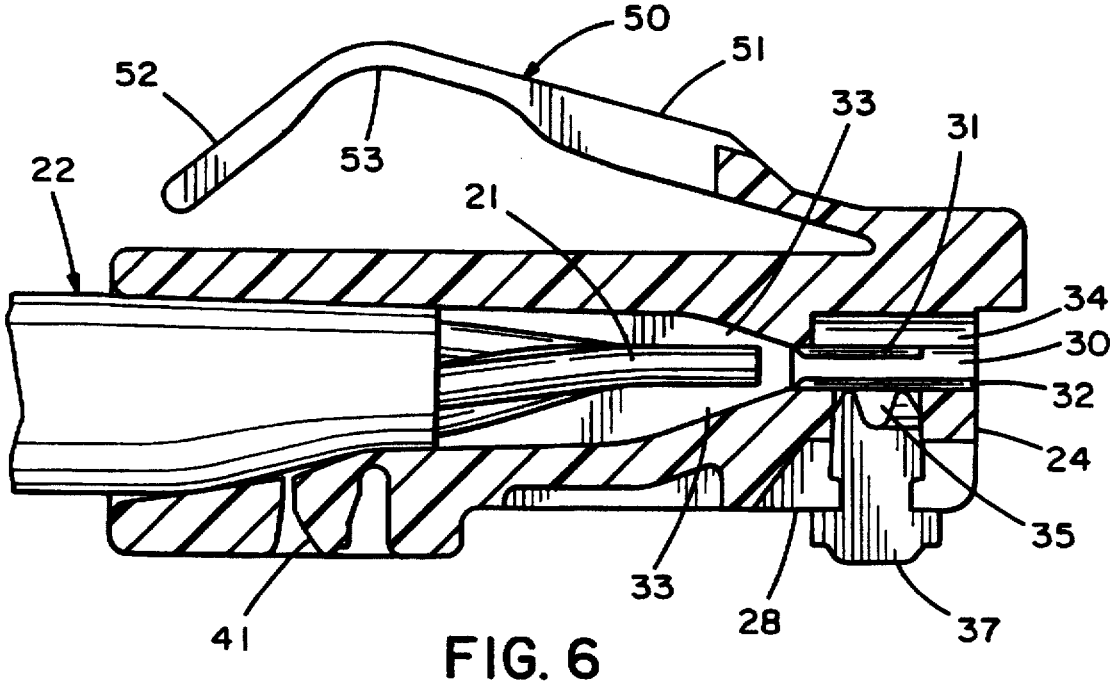
FIG. 6 is a sectional view taken along line 6—6 of FIG. 4 showing the insertion of a planar array of conductors into the connector of FIG. 1.

Cable channel 29 includes inwardly tapering walls 33 (FIG. 6) that guide individual conductors 21 into position in each respective conductor positioning channel 30.

As best seen in FIG. 6–12, disposed parallel and adjacent to every other one of the conductor positioning channels 29 are four conductor termination slots 34 which extend parallel to channels 30 and through front face 24 of connector 20. Slots 34 merge and communicate along their length with respective alternating channels 30 such that a conductor 21 initially positioned in a respective conductor positioning channel 30 can be moved laterally of its length into a respective contiguous slot 34.

Figure 10:
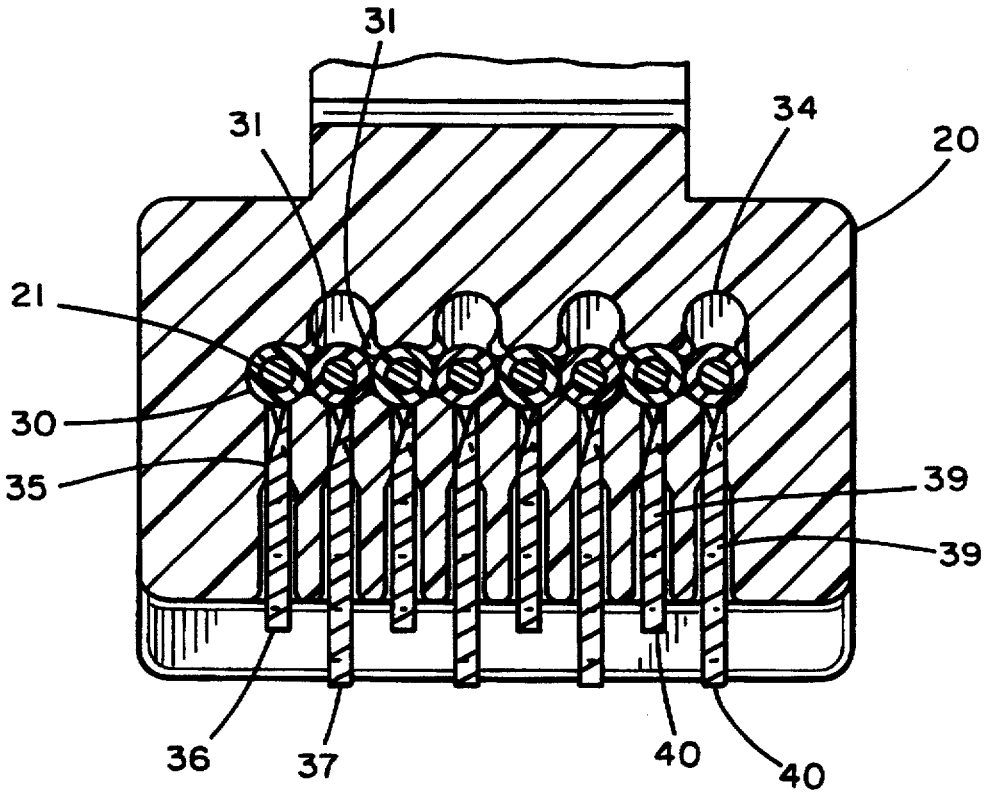
FIG. 10 is a sectional view of the connector prior to termination taken along line 10—10 of FIG. 9.
Figure 11:
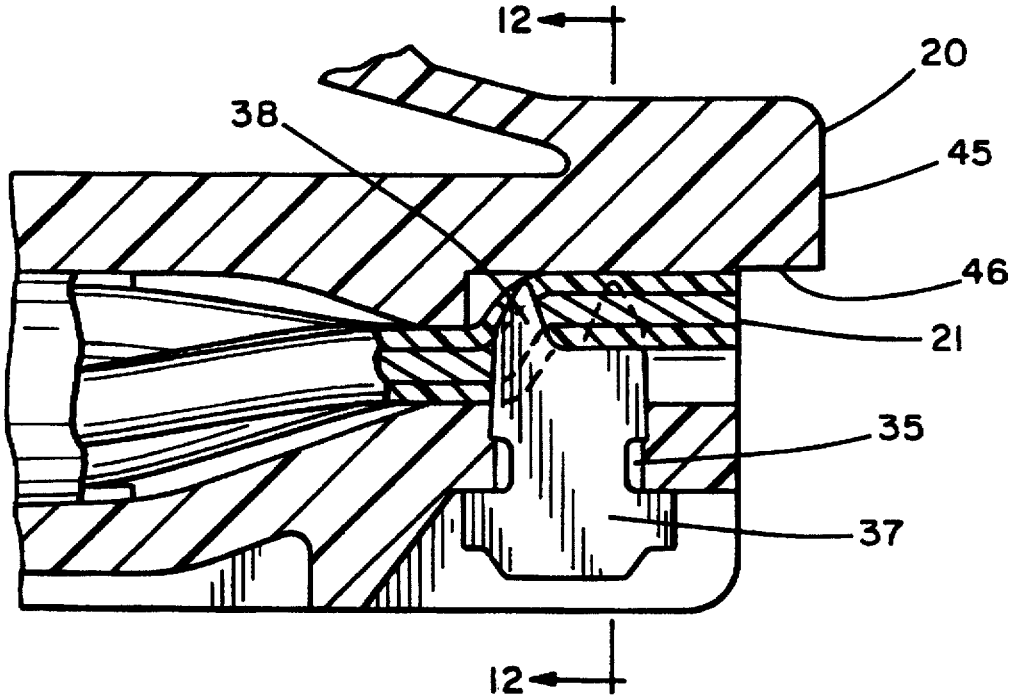
FIG. 11 is a fragmentary sectional view of a terminated connector taken along line 6—6 of FIG. 4 showing terminated conductors.
Figure 12:
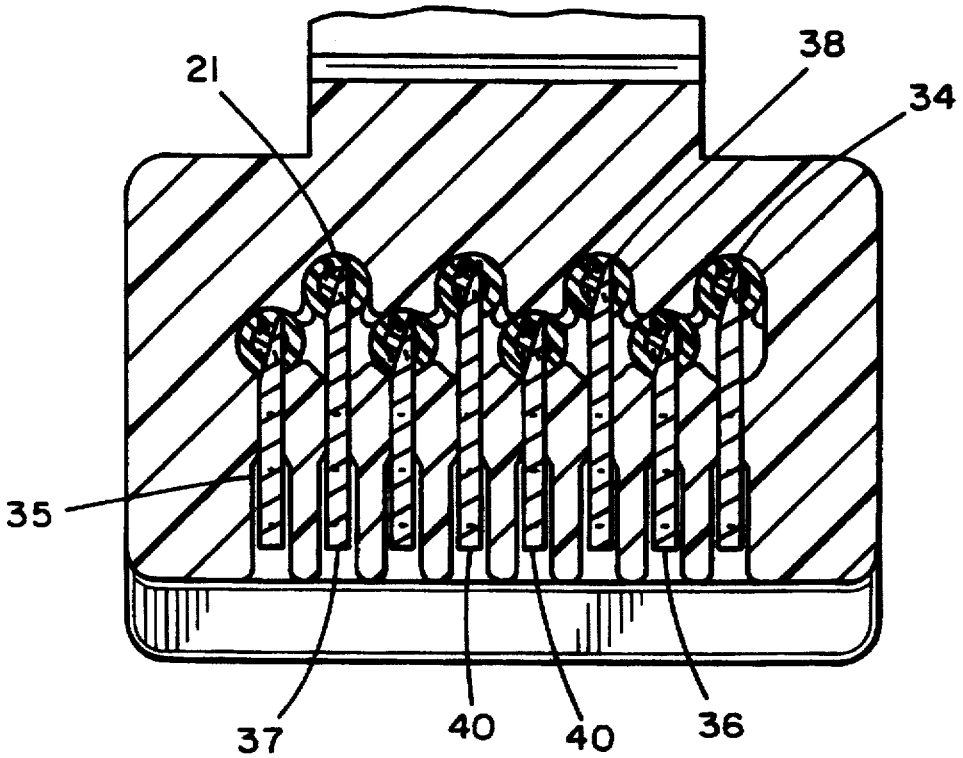
FIG. 12 is a sectional view taken along line 12—12 of FIG. 11.

Upper ridges 31, as seen in FIG. 10, project inwardly to an extent sufficient to interfere with a conductor 21 positioned in channels 30, preventing a conductor from freely entering slot 34, while being spaced apart sufficiently to allow conductor 21 to be forced into slot 34 upon termination.

A plurality of contact slots 35 are formed in bottom wall 28 of connector 20, with each contact slot 35 being aligned with and communicating one of the conductor positioning channels 30 such that planar insulation displacement contacts positioned in contact slots 35 are aligned to terminate conductors 21 positioned in conductor positioning channels 30.

Figure 9:
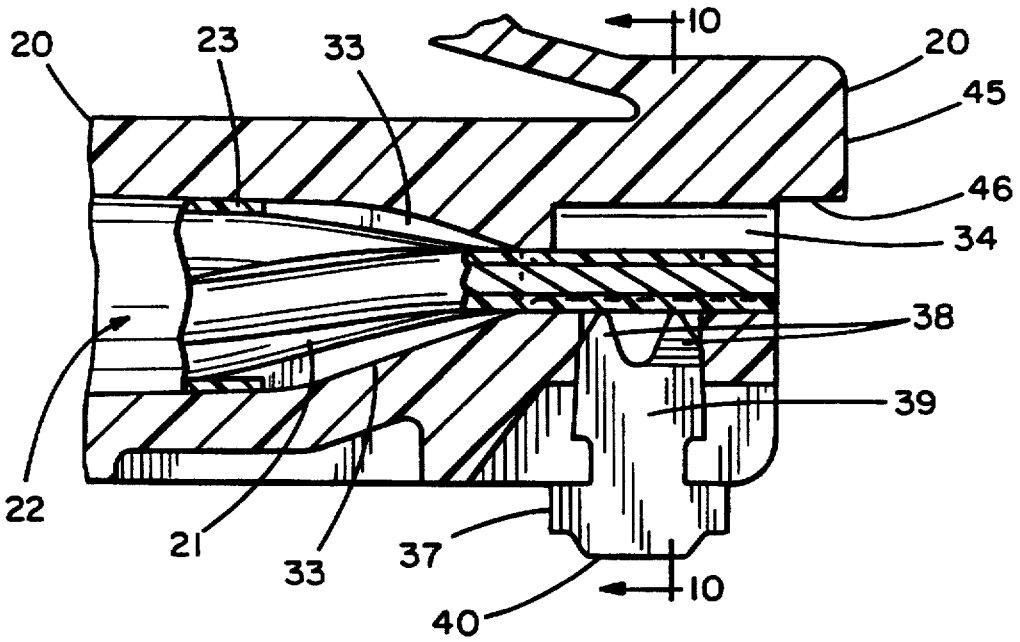
FIG. 9 is a fragmentary sectional view taken along line 6—6 of FIG. 4 showing the position of the conductors prior to termination.

As best seen in FIGS. 9 and 10, planar insulation displacement contacts 36 and translation insulation displacement contacts 37 are disposed in contact slots 35. Insulation displacement contacts 36 and 37 each include insulation piercing barbs 38, a body portion 39 and a outer contact crown 40.

As seen in FIG. 10, body portions 39 of translation contacts 37 are greater in length than body portions 39 of contacts 36. Translation contacts 37 are disposed in contact slots 35 that are aligned with conductor termination slots 34.

As seen in FIGS. 6 and 9–12, the portion of upper conductor positioning ridges 31 opposite barbs 38 of contact 37 initially holds the portion of conductor 21 position therein in alignment with barbs 38 so that barbs 38 of contact 37 pierce the insulation of conductor 21 before translating conductor 21 into conductor termination slot 34, ensuring that conductor 21 does not move out of engagement with contact 37 during termination.

As best seen in FIGS. 5–8, lower conductor positioning ridges 32 extend the length of conductor positioning channels 30 while upper conductor positioning ridges 31 only extend from the entrance of channels 30 to a point just past contact slots 35. Thus upon termination of a conductor by contacts 37 in contact slots 35, the portion of the free end of conductor 21 that extends beyond contact 37 is free to move unimpeded into contact termination slot 34 (FIG. 11) without affecting the quality of the conductive engagement between contact 37 and conductor 21, which may result if ridges 31 extended the length of channels 30 and slots 34 and the free end of conductor 21 could not move freely into slot 34.

Termination of contacts 36 and 37 into conductive engagement with conductors 21 is accomplished by forcing the eight conductors 36 and 37 inwardly into engagement with each individual conductor 21, with longer translation contacts 37 aligned with conductor termination slots 34 displacing the distal end of each conductor from its conductor positioning channel 29 into a contact slot 35 where conductor 21 is terminated. See FIGS. 11 and 12. The shorter length contacts 36 terminate conductors 21 in respective conductor positioning channels 30. The relative length of contacts 36 and 37 are chosen to result in alignment of contact crowns 40 of contacts 36 and 37 after termination of conductors 21 by contacts 36 and 37. See FIG. 12.

A conventional strain relief wedge 41 (FIG. 13) is formed in bottom wall 28 and is disposed to engage sheath 23 of cable 22.

Termination of the conductors of a twisted pair cable within connector 20 is accomplished by removing an end portion of the sheath of cable 22, untwisting and arranging the eight conductors 21 in a parallel orientation and in the correct sequence in a substantially planar array with the extent of the untwisted, parallel distal end of conductors 21 being sufficient to securely grasp the arranged array during insertion into connector 20, inserting the array of conductors 21 through conductor positioning channels 30 (FIG. 6) with the free ends of the conductors projecting past front face 24, pulling the free ends of the conductors outwardly to draw the twisted sections of each conductor pair tightly into the connector to ensure that the twisted portions of the conductors are as close as possible to contacts 36 and 37, forcing contacts 36 and 37 into conductive engagement with conductors 21 and stain relief wedge 41 into engagement with sheath 23 (FIGS. 9–13) with a modular plug termination tool (not shown), and severing the portion of conductors 21 extending from front face 24 of connector 20. The termination tool (not shown) initially engages insulation displacement contacts 37 forcing contacts 37 inwardly against conductors 21 positioned in respective conductor positioning channels 30. Continued inward movement of contacts 37 forces conductors 21 between upper ridges 31 into conductor termination slots 34, with the tool then engaging contacts 36 and 37 to force all of the contacts inwardly to terminate contacts 36 and 37 to conductors 21. An alternative termination method would sever the portion of the conductors extending from front face 24 of connector 20 after pulling the conductors tightly into connector 20 and prior to termination of contacts 36 and 37 to conductors 21.

To prevent any possibility of undesired contact with terminated conductors 21, front face 24 of connector 20 could be covered with a snap-on cap (not shown) or other means to close and seal channels 30 and slots 34 after termination of conductors 21.

Figure 3:
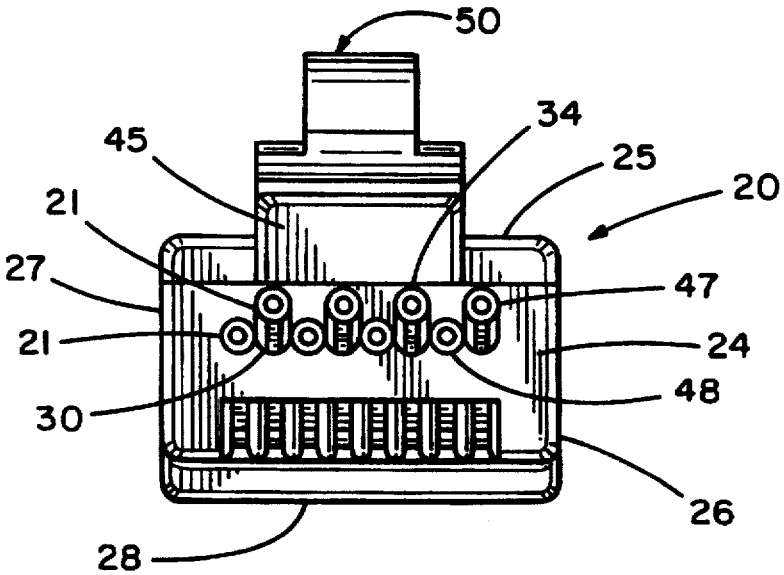
FIG. 3 is front view of the connector of FIG. 1.
Figure 4:
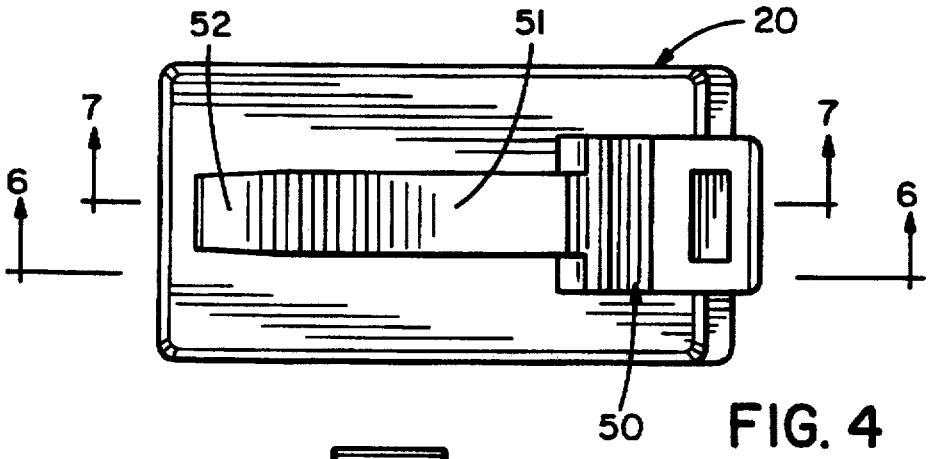
FIG. 4 is a top view of the connector of FIG. 1.
Figure 13:
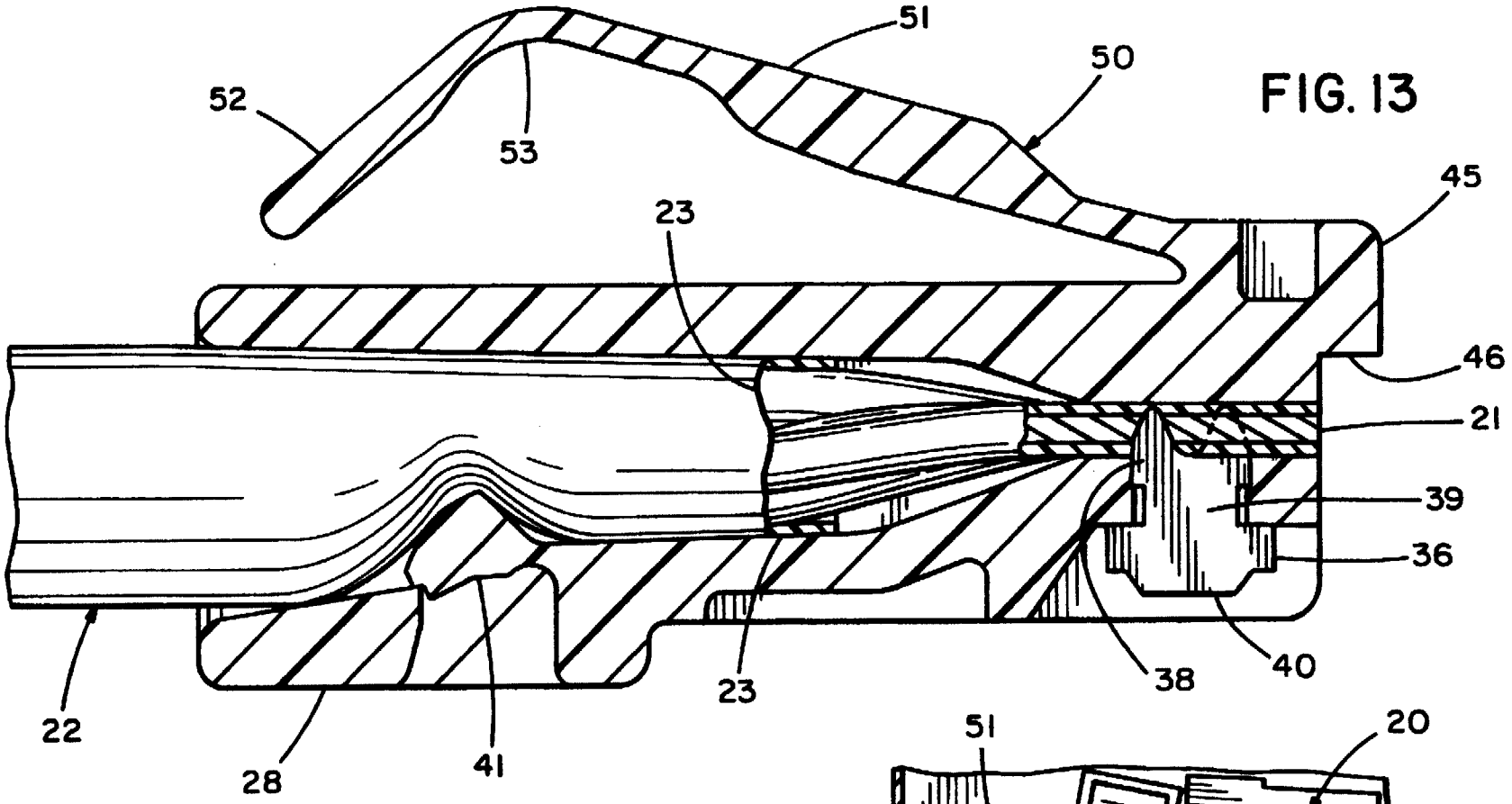
FIG. 13 is a sectional view showing the connector of FIG. 1 terminated to a cable.

As seen in FIGS. 1, 3 and 13, connector 20 includes a guide nose 45 formed on top wall 25 and projecting beyond front wall 24 which is designed to guide connector into accurate alignment with a standard jack connector. As seen in FIG. 3, Guide nose 45 is medially aligned with the width of connector 20 and is only adjacent to three of four conductor termination slots 34. Guide nose 45 includes an anvil surface 46 (FIG. 13) which supports the conductors 21 disposed in the three conductor termination slots 34 adjacent to guide nose 45 during cutoff of conductors 21. As seen in FIG. 3, conductor 21 in unsupported termination slot 47, is not supported by anvil surface 46 which, depending upon the construction of the termination tool, could prevent a clean cut off of conductor 21 in sot 47. To prevent any such possibility, connector 20 can be modified to remove this unsupported termination slot 47 and merely utilize an additional conductor positioning channel 30 aligned with an adjacent conductor positioning channel 48, thus using only three staggered conductor termination slots 34 while still achieving Category 5 performance. Alternatively, slot 47 of FIG. 3 could be formed in a partially staggered position between the fully staggered slots 34 and channels 30.

When used to terminate shielded or unshielded 100 ohm cable twisted pair Category 5 cable meeting EIA/TIA TSB-36, the final staggered disposition of the distal ends of conductors 21 provides a plug connector that has been found to reduce cross talk induced by the connector an amount sufficient to consistently exceed Category five cross talk performance as specified by the Electronics Industries Association and the Telecommunications Industry Association, "EIA/TIA" in specification SP-2840, with the plug and cable tested under TSB-67 certification test equipment for Category 5 Compliance and the plug alone tested under TSB-40 Termination Component Requirements while providing a connector that can be economically manufactured and easily terminated, without the use of a separate wire loading bar, merely by inserting a planar array of conductors into the connector and terminating the plug connector.

Although described as used in a modular plug connector, the present invention would be useful in any type of connector to reduce cross talk in a connector where it is desirable to initially position a substantially planar array of conductors in the connector for termination.

Figure 7:
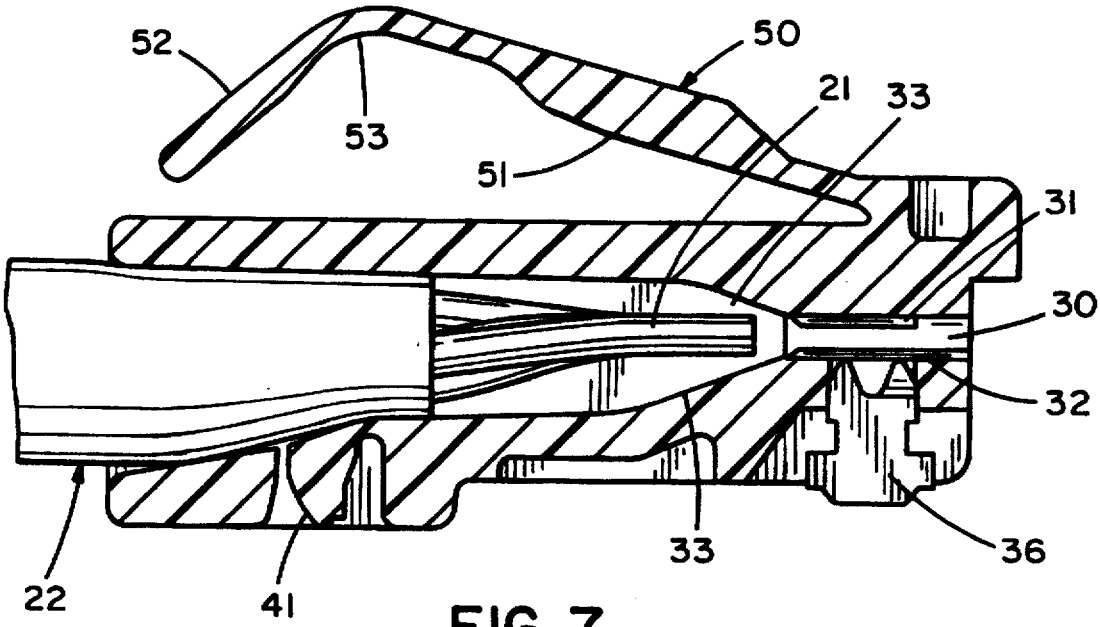
FIG. 7 is a sectional view taken along line 7—7 of FIG. 4 showing the insertion of a planar array of conductors into the connector of FIG. 1.
Figure 8:
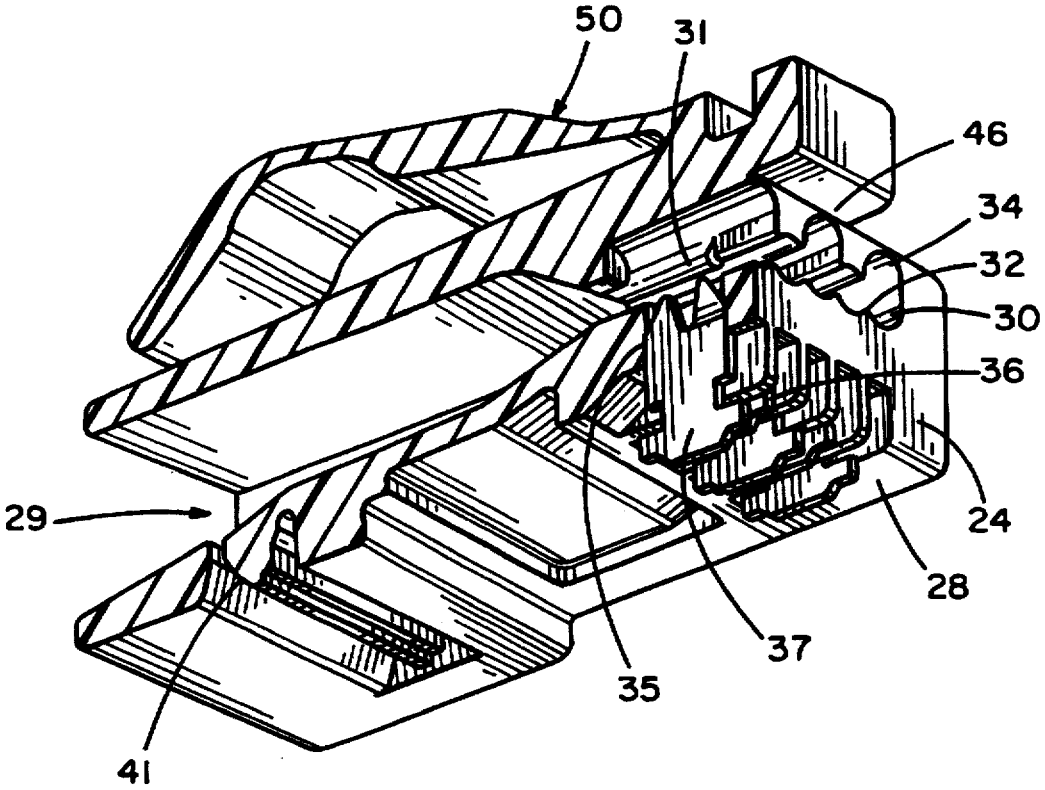
FIG. 8 is a perspective view of the connector of FIG. 1, sectioned along line 6—6 of FIG. 4.
Figure 14:
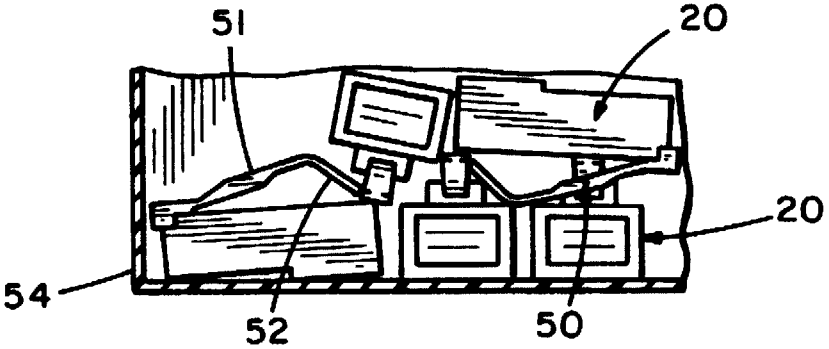
FIG. 14 is a fragmentary sectional view of a container for a plurality of connectors.

As best seen in FIGS. 1 and 7, connector 20 includes a cantilever latch arm 50 having a first portion 51 integrally formed with connector 20 which extends outwardly away from the connector 20 and a free end portion 52 joined to the first portion by a living hinge 53. Free end portion 52 extends downwardly toward top wall 25 of connector 20 terminating in close proximity to top wall 25 such that free end portion 52 is less likely to tangle with other latch arms 50 of other connectors 20 in a package of connectors 54, see FIG. 14, or snag on other surfaces when in use. Latch arm 50 prevents snagging or tangling of the latch arm while allowing free unimpeded access to latch arm 50 in use to facilitate release of connector 20 from a jack.

Figure 15:
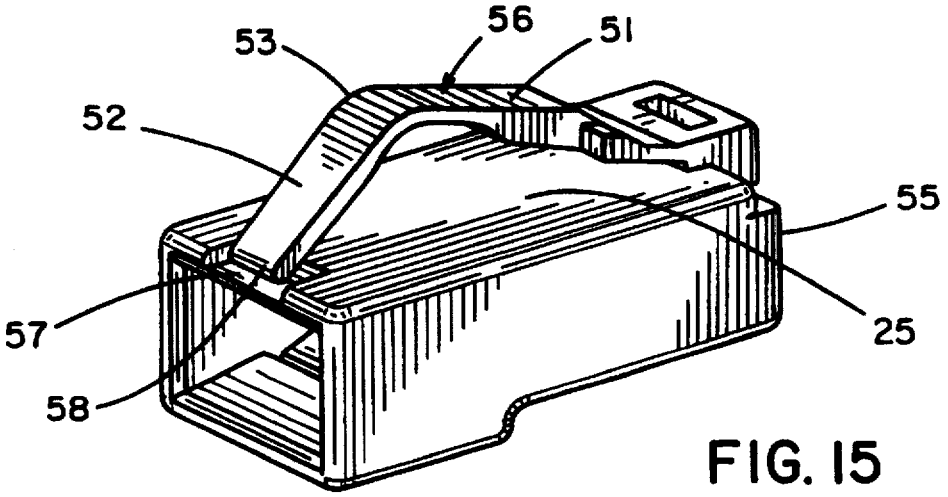
FIG. 15 is a perspective view of a modular plug connector having an enhanced tangle free latch arm embodying the concept of the present invention.
Figure 16:
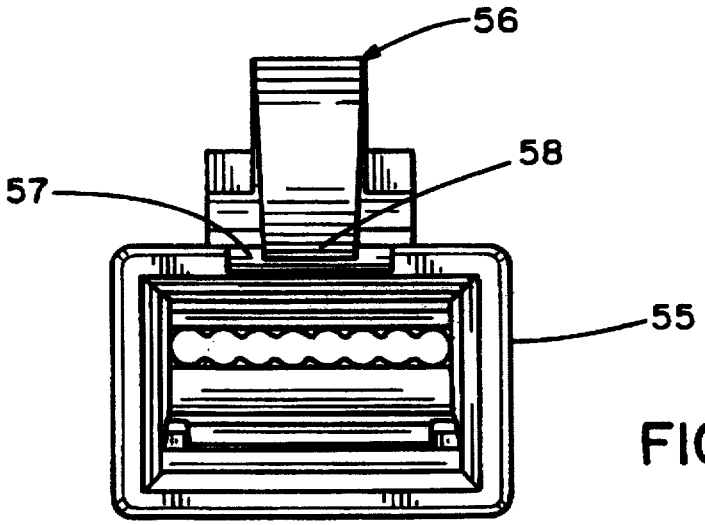
FIG. 16 is a rear view of the connector of FIG. 15.
Figure 17:
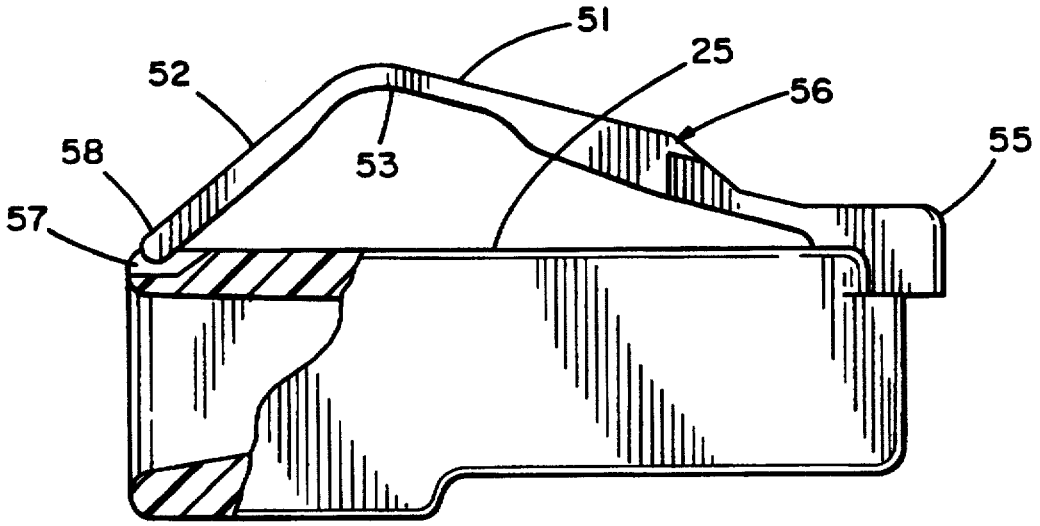
FIG. 17 is a side view of the connector of FIG. 15.

Another embodiment is depicted in FIGS. 15–17, showing a connector 55 having a tangle free latching arm 56 with common features as described and numbered above is depicted in FIGS. 15–17. Connector 55 includes a inset or depression 57 formed in top wall 25 of connector 55, which is disposed to receive the distal tip 58 of free end portion 52 such that tip 58 extends below the surface of top wall 25 and does not leave any gap between tip 58 and top wall 25 to prevent any possibility of another object snagging there between.

While the particular preferred embodiments of the present invention has been shown and described, it will be obvious to those skilled in the art that changes and modifications may be made without departing from the teachings of the invention.

We claim:

1. A connector for terminating a plurality of conductors of a plurality of conductor pairs, comprising:

first means for initially positioning the conductors in a substantially planar array, including a plurality of substantially planar conductor positioning channels; and second means for positioning at least one of the conductors away from another one of the conductors such that cross talk between the conductor pairs is reduced, including at least one conductor termination slot disposed adjacent one of the conductor positioning channels, wherein the second means for positioning includes a translation contact mounted in the connector and aligned with a conductor positioning channel and an adjacent conductor termination slot such that a termination force applied to the contact moves the contact against a conductor initially positioned in the aligned conductor positioning channel and moves the conductor into the aligned conductor termination slot.

2. A connector for terminating a plurality of conductors of a plurality of conductor pairs, comprising;

first means for initially positioning the conductors in a substantially planar array including a plurality of substantially planar conductor positioning channels; and second means for positioning at least one of the conductors away from another one of the conductors such that cross talk between the conductor pairs is reduced, including at least one conductor termination slot disposed adjacent one of the conductor positioning channels, wherein the second means for positioning includes a plurality of translation contacts each mounted in the connector and each aligned with a respective conductor positioning channel and a conductor termination slot such that a termination force applied to the contact moves the contact against a conductor initially positioned in the conductor positioning channel and moves the conductor into the conductor termination slot and wherein the translation contacts are disposed adjacent to a plurality of contacts mounted in the connector and disposed to terminate a conductor in one of the conductor positioning channels such that adjacent terminated conductors are disposed away from each other.

3. A connector as set forth in claim 2, wherein each conductor positioning channel and conductor termination slot aligned with a translation contact are parallel and communicate with each other and wherein each conductor positioning channel extends through a face of the connector.

4. A connector as set forth in claim 2, wherein each conductor positioning channel and conductor termination slot aligned with a translation contact are separated by a pair of ridges spaced apart an amount to prevent a conductor from freely entering the conductor termination slot while allowing the conductor to be forced into the conductor termination slot by the translation contact.

5. A connector as set forth in claim 4, wherein the ridges do not extend the length of at least one adjacent conductor positioning channel and at least one conductor termination slot such that at least one distal end of a conductor is free to move without interference from the conductor positioning channel into the conductor termination slot.

6. A connector as set forth in claim 3, wherein translation contacts terminate every other one of the conductors in the conductor positioning channels.

7. A connector for terminating a plurality of conductors of a plurality of conductor pairs, comprising:

a plurality of substantially planar conductor positioning channels for initially positioning the conductors in a substantially planar array;

at least one conductor termination slot disposed adjacent one of the conductor positioning channels; and a translation contact mounted in the connector and aligned with the conductor positioning channel and the adjacent conductor termination slot such that a termination force applied to the contact moves the contact against a conductor initially positioned in the aligned conductor positioning channel and moves the conductor into the aligned conductor termination slot such that cross talk between the conductor pairs is reduced.

8. A connector as set forth in claim 7, including plurality of translation contacts each mounted in the connector and each aligned with a respective conductor positioning channel and a conductor termination slot and wherein the translation contacts are disposed adjacent to a plurality of contacts mounted in the connector and disposed to terminate a conductor in one of the conductor positioning channels such that adjacent terminated conductors are disposed away from each other.

9. A connector as set forth in claim 8, wherein each conductor positioning channel and conductor termination slot aligned with a translation contact are parallel and communicate with each other and wherein each conductor positioning channel extends through a face of the connector.

10. A connector as set forth in claim 8, wherein each conductor positioning channel and conductor termination slot aligned with a translation contact are separated by a pair of ridges spaced apart an amount to prevent a conductor from freely entering the conductor termination slot while allowing the conductor to be forced into the conductor termination slot by the translation contact.

11. A connector as set forth in claim 10, wherein the ridges do not extend the length of at least one adjacent conductor positioning channel and conductor termination slot such that at least one distal end of a conductor is free to move without interference from the conductor positioning channel into the conductor termination slot.

12. A connector as set forth in claim 11, wherein translation contacts terminate every other one of the conductors in the conductor positioning channels.

13. A method of terminating a connector to a plurality of conductors, where the connector includes a plurality of substantially planar conductor positioning channels with at least one channel disposed adjacent to at least one conductor termination slot, comprising the steps of:

arranging the conductors in a substantially planar array;

inserting the array of conductors into the conductor positioning channels of the connector; and moving at least one of the conductors into a conductor termination slot away from an adjacent conductor in the array such that cross talk between the conductors is reduced.

14. A method as set forth in claim 13, wherein the conductor is moved into the conductor termination slot by a contact and terminated to the conductor.

15. A method as set forth in claim 14, including the steps of pulling free ends of the conductors to draw the conductors tight before the conductors are terminated to contacts of the connector, terminating the contacts to the conductors and severing the free ends of the conductors.

* * * * *